US009833892B1

(12) United States Patent
Gomez

(10) Patent No.: US 9,833,892 B1
(45) Date of Patent: Dec. 5, 2017

(54) PORTABLE WORKBENCH ASSEMBLY

(71) Applicant: Juan Gomez, Antioch, CA (US)

(72) Inventor: Juan Gomez, Antioch, CA (US)

( * ) Notice: Subject to any disclaimer, the term of this patent is extended or adjusted under 35 U.S.C. 154(b) by 0 days.

(21) Appl. No.: 15/445,243

(22) Filed: Feb. 28, 2017

(51) Int. Cl.
*A47F 5/04* (2006.01)
*B25H 1/12* (2006.01)
*B25H 1/04* (2006.01)
*B65D 88/12* (2006.01)

(52) U.S. Cl.
CPC ..... *B25H 1/12* (2013.01); *B25H 1/04* (2013.01); *A47F 5/04* (2013.01); *B65D 88/121* (2013.01)

(58) Field of Classification Search
CPC .... B25H 1/12; B25H 1/04; B27C 5/04; B27C 5/02; B27C 5/06; B65D 88/12; A47F 5/04; B23Q 1/03; B23Q 3/06; B62B 3/02; B62B 3/022; B62B 3/12
USPC ... 108/115, 163, 167, 169, 171, 174, 25, 26, 108/50.02; 248/166, 434, 435, 170, 171, 248/436, 177.1, 178.1, 188.6; 211/85.8, 211/196, 197; 269/901
See application file for complete search history.

(56) References Cited

U.S. PATENT DOCUMENTS 23,428 A * 3/1859 Lewis ..... F16M 11/28 248/171
106,805 A * 8/1870 French ..... A47B 3/04 108/156
574,486 A * 1/1897 Jones ..... B25H 1/06 182/182.4
793,151 A * 6/1905 Palmer ..... D06F 1/02 126/30
873,121 A * 12/1907 Flory ..... F16M 11/16 248/177.1
882,468 A * 3/1908 Huebner ..... A47C 9/105 248/171
898,263 A * 9/1908 Rice ..... A47G 1/16 211/175
906,963 A * 12/1908 Thompson ..... D06F 57/04 211/165
1,173,051 A * 2/1916 Smith ..... F16M 11/10 248/169
1,209,150 A * 12/1916 Hannold ..... A47B 3/04 108/167
1,250,833 A * 12/1917 Flanegin ..... A47F 5/06 211/172

(Continued)

FOREIGN PATENT DOCUMENTS

WO WO2008028554 3/2008

*Primary Examiner* — Joshua J Michener
*Assistant Examiner* — Devin Barnett

(57) ABSTRACT

A portable workbench assembly for retaining tools and electronic devices proximate to a work space includes a vertical support that has a top end and a bottom end. A horizontal support is coupled to and extends substantially perpendicularly from the vertical support proximate to the top end. A plurality of trays is coupled to the horizontal support. A base, which is wheeled, is coupled to and extends from the vertical support proximate to the bottom end. A connection box is selectively couplable to a respective tray. The base is rollable on a surface to position the trays proximate to a work area. The trays are configured to retain items, such as tools and electronic devices, within the trays such that the items are readily available to a user. The connection box is configured to couple the electronic devices, such as power tools, to a source of alternating current.

18 Claims, 5 Drawing Sheets

(56) References Cited

U.S. PATENT DOCUMENTS 1,325,164 A * 12/1919 Mowrey ..... A47B 3/04 108/34
1,490,606 A * 4/1924 Hygino Da Trindade Do Ceu Faria ..... A47B 3/00 108/128
1,502,629 A * 7/1924 Hardy ..... A47C 9/105 248/155.1
1,552,479 A * 9/1925 Goldberg ..... A47B 83/04 126/30
1,894,695 A * 1/1933 Ley ..... F16M 11/10 248/171
1,969,107 A * 8/1934 Stone ..... A47F 5/04 211/196
2,277,332 A * 3/1942 Lamb ..... A47G 25/0664 211/171
2,374,021 A * 4/1945 Korling ..... F16M 11/28 248/170
2,604,932 A * 7/1952 Leggett ..... A47B 3/00 108/128
2,613,901 A * 10/1952 Tatar ..... G10G 5/00 248/167
2,794,612 A * 6/1957 Clifton ..... F16M 11/28 108/1
3,038,690 A * 6/1962 Alexiou ..... A47C 4/24 108/128
3,076,557 A * 2/1963 Husted ..... A45F 3/44 108/148
3,113,531 A * 12/1963 Barnard ..... A47B 13/023 108/115
3,115,849 A * 12/1963 Johnson ..... A47B 9/08 108/148
3,123,935 A * 3/1964 Williams ..... A47B 13/16 108/116
3,228,360 A * 1/1966 Jones ..... F16M 11/04 108/158
3,324,928 A * 6/1967 Muller ..... G03B 21/58 160/24
3,417,952 A * 12/1968 Bieschke ..... G03B 21/58 248/171
3,545,738 A * 12/1970 Stagg ..... A61G 13/105 108/167
4,034,684 A * 7/1977 Carson ..... B25H 1/04 108/116
4,150,861 A * 4/1979 Dufrancatel ..... A47B 46/005 312/266
4,192,480 A * 3/1980 Schmidt ..... A47B 3/12 108/173
4,378,709 A * 4/1983 Chitayat ..... F16H 19/025 108/143
D269,880 S * 7/1983 Iwasaki ..... D16/244
4,597,553 A * 7/1986 Rorabaugh ..... A47B 9/16 108/117
4,852,836 A * 8/1989 Kawazoe ..... F16M 11/32 248/168
4,988,064 A * 1/1991 Hoshino ..... F16M 11/046 248/165
5,024,257 A * 6/1991 Lloyd ..... B27C 5/02 144/1.1
5,042,542 A * 8/1991 Purviance ..... B27C 5/02 144/134.1
5,161,590 A * 11/1992 Otto ..... B23D 47/025 144/285
5,301,992 A * 4/1994 Whitmore ..... B60R 5/04 224/542
5,924,684 A * 7/1999 Cheng ..... B25H 1/04 269/139
5,992,805 A * 11/1999 Tanner ..... A47B 19/00 248/125.8
6,149,145 A * 11/2000 Lin ..... B25H 1/14 269/139
6,164,016 A * 12/2000 Bue ..... E04H 3/28 108/167
6,282,084 B1 * 8/2001 Goerdt ..... F16M 11/16 108/115
6,286,824 B1 * 9/2001 Sagol ..... B25H 1/04 269/900
D448,948 S * 10/2001 Wolff ..... D6/684
6,305,653 B1 * 10/2001 Oldham ..... F16M 11/04 248/125.8
6,523,919 B1 * 2/2003 Israelsen ..... A47B 63/00 312/310
6,604,720 B1 * 8/2003 Wilson ..... A47B 23/04 248/177.1
6,637,350 B2 * 10/2003 McKsymick ..... A47B 21/00 108/25
6,659,440 B2 * 12/2003 Levy ..... B25H 1/04 269/100
6,688,634 B2 * 2/2004 Noffsinger ..... B25H 3/06 280/47.19
6,748,873 B2 * 6/2004 Brown, Sr. ..... A47B 3/10 108/49
6,769,674 B2 * 8/2004 Chang ..... B25H 1/04 269/139
6,942,269 B2 * 9/2005 Mains ..... B60N 3/001 108/44
7,220,194 B1 * 5/2007 Laiacona, Jr. ..... A63B 63/00 473/454
7,604,207 B2 * 10/2009 Hasloecher ..... F16M 11/42 16/32
7,744,048 B1 * 6/2010 McKellery ..... F16M 11/041 248/176.1
8,051,783 B1 * 11/2011 Hoskinson ..... A47B 37/00 108/23
8,172,077 B1 * 5/2012 Gray ..... B25H 1/04 190/107
8,397,647 B1 * 3/2013 Riegel ..... A61M 16/00 108/24
8,418,860 B2 * 4/2013 Rimmer ..... G06F 57/04 211/196
8,496,289 B2 * 7/2013 Chen ..... A47B 3/083 108/130
8,526,176 B2 * 9/2013 Clark ..... A61B 5/0002 248/918
8,613,454 B2 * 12/2013 Foley ..... A47B 23/046 108/147
8,899,415 B2 * 12/2014 McCosh ..... H05K 5/03 206/320
9,027,895 B2 * 5/2015 Hunter ..... G01C 15/06 248/125.8
9,073,201 B1 * 7/2015 Foley ..... B25H 5/00
2002/0056794 A1 * 5/2002 Ibrahim ..... A47B 19/00 248/177.1
2003/0102414 A1 * 6/2003 Smart ..... A01K 97/10 248/170
2004/0257464 A1 * 12/2004 Pandit ..... H04N 5/2251 348/373
2005/0012000 A1 * 1/2005 Jones ..... B23Q 3/186 248/178.1
2006/0289320 A1 * 12/2006 Miller ..... B25H 1/04 206/373
2007/0090237 A1 * 4/2007 Hsu ..... F16M 11/14 248/178.1
2007/0095257 A1 * 5/2007 Hernandez ..... A47B 3/0815 108/115
2007/0114345 A1 * 5/2007 Lee ..... F16M 11/42 248/166
2007/0131825 A1 * 6/2007 Skrodzki ..... F16M 11/10 248/177.1
2007/0138366 A1 * 6/2007 Davis ..... E04H 3/28 248/434
2007/0234934 A1 * 10/2007 Branch ..... A47B 23/046 108/115
2008/0035030 A1 * 2/2008 Horton ..... A47B 21/0073 108/50.02
2008/0078914 A1 * 4/2008 Liao ..... G10D 13/026 248/435
2008/0296447 A1 * 12/2008 Peterson ..... A61B 17/54 248/171

(56) References Cited

U.S. PATENT DOCUMENTS

| | | | | |
|---|---|---|---|---|
| 2009/0000522 | A1* | 1/2009 | Collins | B25H 1/04 108/12 |
| 2009/0050028 | A1* | 2/2009 | Liao Fang | A47B 13/12 108/26 |
| 2009/0241811 | A1* | 10/2009 | Markegard | A47B 3/00 108/118 |
| 2009/0250572 | A1* | 10/2009 | Cheng | A47B 47/0008 248/188.6 |
| 2009/0283019 | A1* | 11/2009 | Chen | A47B 3/00 108/115 |
| 2011/0017107 | A1* | 1/2011 | Ko | A47B 3/0818 108/64 |
| 2011/0056898 | A1* | 3/2011 | Foley | A47B 23/046 211/85.8 |
| 2011/0297052 | A1* | 12/2011 | Martin | A47B 13/003 108/27 |
| 2013/0139737 | A1* | 6/2013 | Kleinklaus | A47B 3/087 108/166 |
| 2013/0305966 | A1* | 11/2013 | Hendershot | A47B 3/00 108/115 |
| 2013/0333595 | A1* | 12/2013 | Cotey | A47B 3/0815 108/42 |
| 2015/0344240 | A1* | 12/2015 | Gao | B62B 3/02 211/85.8 |
| 2016/0106210 | A1* | 4/2016 | Kassanoff | A47B 41/00 108/25 |

* cited by examiner

PORTABLE WORKBENCH ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to workbench assemblies and more particularly pertains to a new workbench assembly for retaining tools and electronic devices proximate to a work space.

BRIEF SUMMARY OF THE INVENTION

An embodiment of the disclosure meets the needs presented above by generally comprising a vertical support that has a top end and a bottom end. A horizontal support is coupled to and extends substantially perpendicularly from the vertical support proximate to the top end. A plurality of trays is coupled to the horizontal support. A base, which is wheeled, is coupled to and extends from the vertical support proximate to the bottom end. A connection box is selectively couplable to a respective tray. The base is rollable on a surface such that the trays are configured to position proximate to a work area. The trays are configured to retain items, such as tools and electronic devices, within the trays such that the items are readily available to a user. The connection box is configured to couple the electronic devices, such as power tools, to a source of alternating current.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
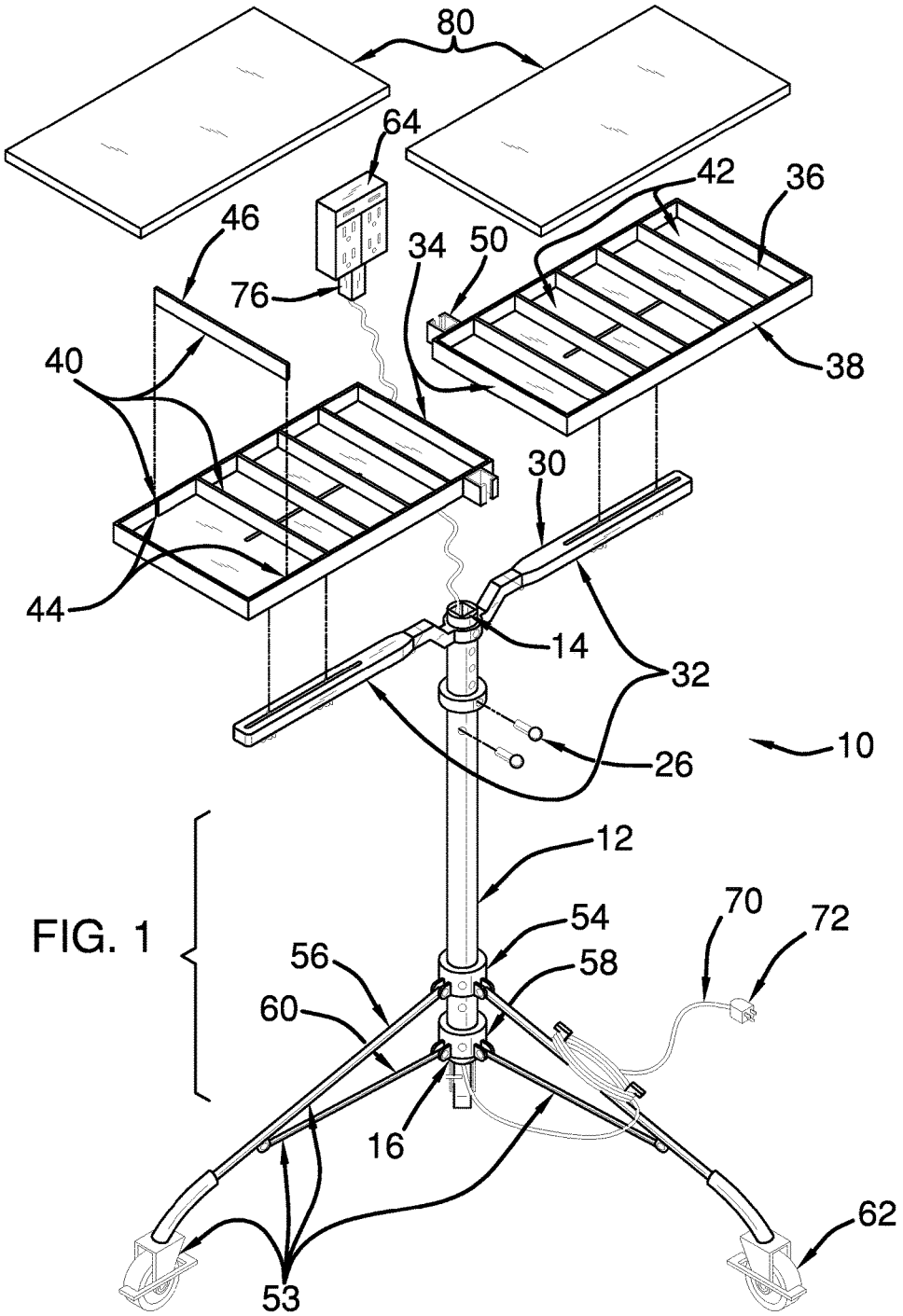
FIG. 1 is an isometric perspective view of a portable workbench assembly according to an embodiment of the disclosure.
Figure 2:
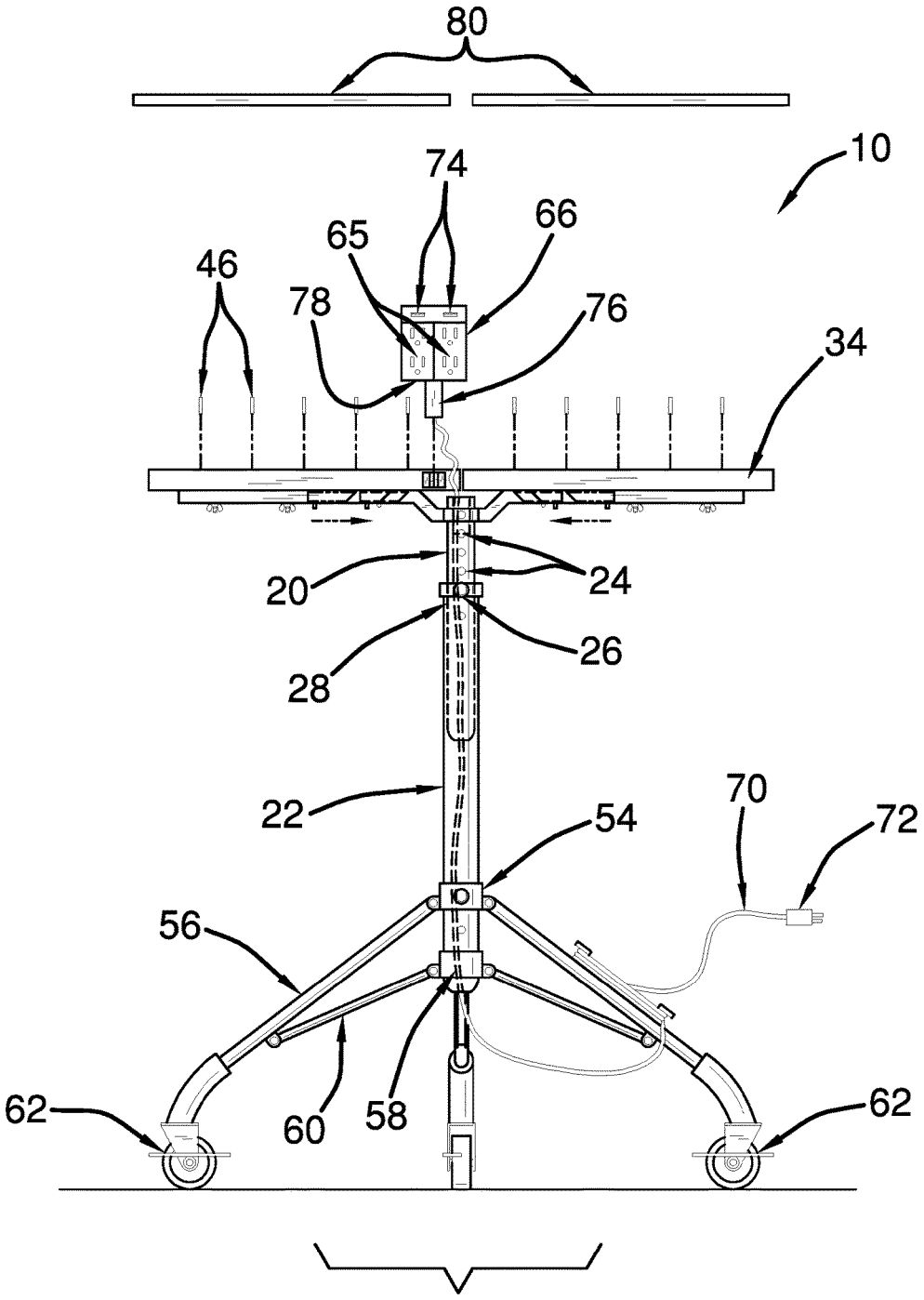
FIG. 2 is a side view of an embodiment of the disclosure.
Figure 3:
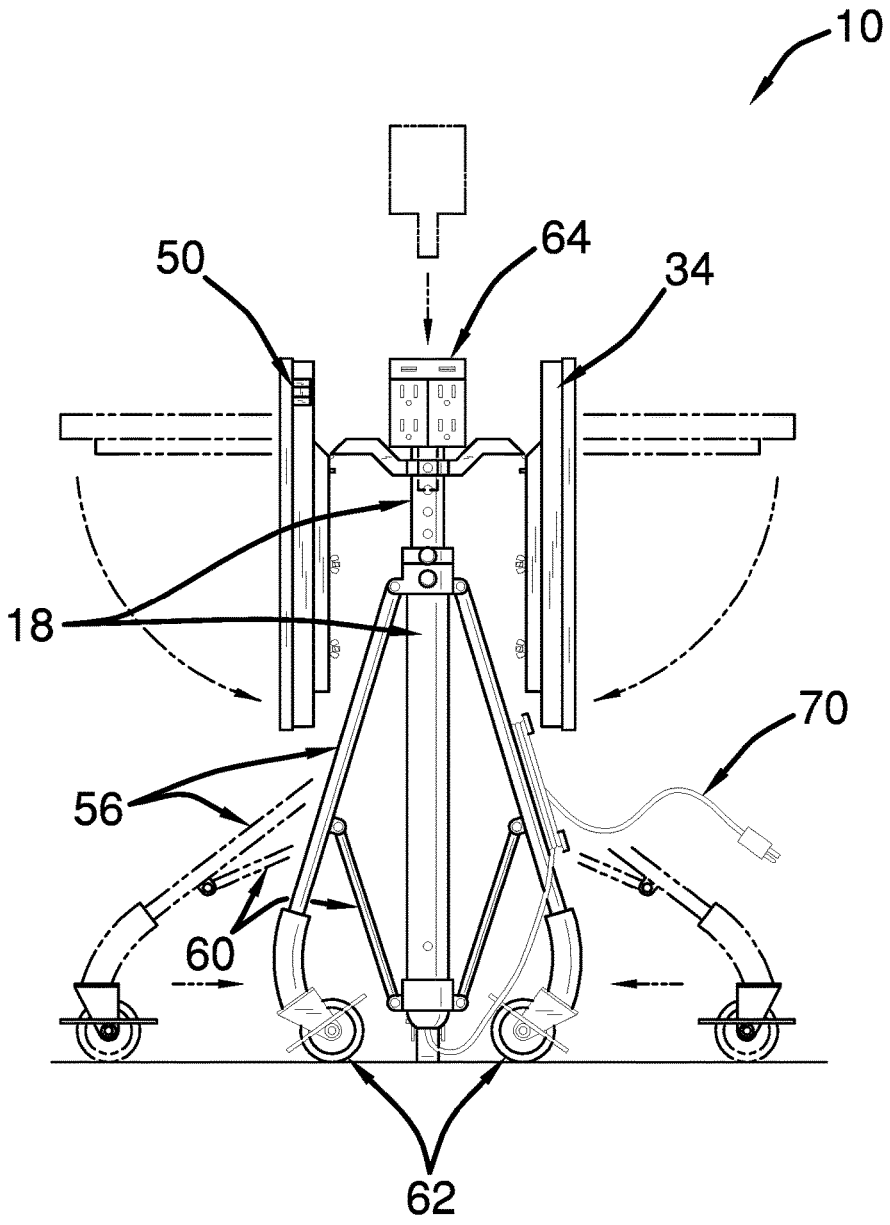
FIG. 3 is a side view of an embodiment of the disclosure.
Figure 4:
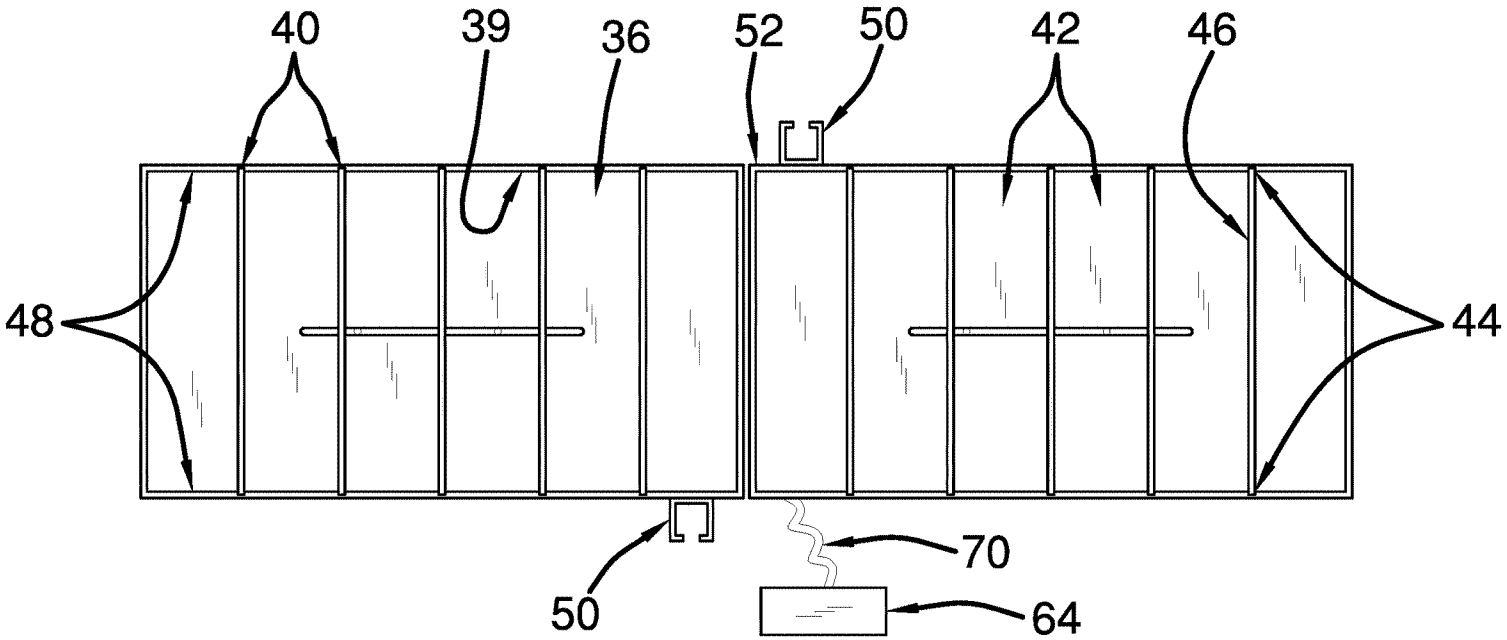
FIG. 4 is a top view of an embodiment of the disclosure.
Figure 5:
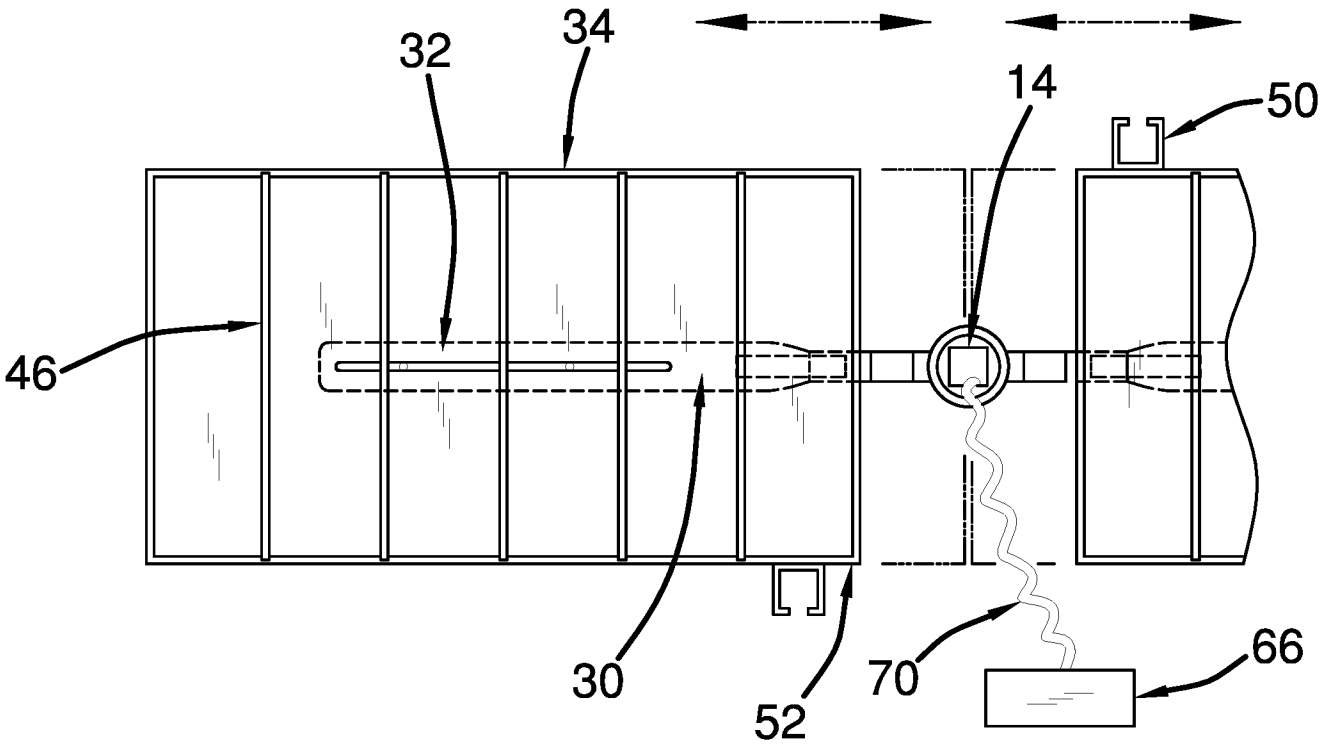
FIG. 5 is a top view of an embodiment of the disclosure.

With reference now to the drawings, and in particular to FIGS. 1 through 5 thereof, a new workbench assembly embodying the principles and concepts of an embodiment of the disclosure and generally designated by the reference numeral 10 will be described.

As best illustrated in FIGS. 1 through 5, the portable workbench assembly 10 generally comprises a vertical support 12 that has a top end 14 and a bottom end 16. In one embodiment, the vertical support 12 is tubular. In another embodiment, the vertical support 12 comprises a plurality of nested sections 18, such that the vertical support 12 is variably extendable. In yet another embodiment, the plurality of nested sections 18 comprises an upper segment 20 and a lower segment 22. In still yet another embodiment, the vertical support 12 is substantially circularly shaped when viewed longitudinally.

A plurality of holes 24 is positioned in the upper segment 20. The holes 24 are both linearly and longitudinally positioned in the upper segment 20. A locking pin 26 is coupled to the lower segment 22 proximate to an upper end 28 of the lower segment 22. The locking pin 26 is complementary to the holes 24. The holes 24 are positioned in the upper segment 20 and are positioned to couple to the locking pin 26 such that the upper segment 20 is coupled to the lower segment 22.

A horizontal support 30 is coupled to and extends substantially perpendicularly from the vertical support 12 proximate to the top end 14. In one embodiment, the horizontal support 30 comprises a pair of arms 32. The arms 32 are hingedly coupled to the vertical support 12. The arms 32 are foldable from an extended position with the arms 32 perpendicular to the vertical support 12 to a collapsed position with the arms 32 substantially parallel to the vertical support 12.

A plurality of trays 34 is coupled to the horizontal support 30. The trays 34 are configured to position and retain items within the trays 34. In one embodiment, each tray 34 is slidably couplable to a respective arm 32, such that the tray 34 is variably positionable relative to the vertical support 12. In another embodiment, the plurality of trays 34 comprises trays 34 coupled singly to each arm 32.

Each tray 34 comprises a plate 36 and a rim 38. The plate 36 is substantially rectangularly shaped. The rim 38 is coupled to and extends perpendicularly from a perimeter 39 of the plate 36, such that the trays 34 are substantially rectangularly box shaped.

A plurality of dividers 40 is reversibly couplable to the trays 34 to define a plurality of compartments 42. Each divider 40 comprises a pair of grooves 44, which is opposingly positioned in the rim 38, and a slat 46 that is reversibly positionable in the grooves 44. The slat 46 extends between opposing sides 48 of the rim 38. In one embodiment, the plurality of dividers 40 comprises ten dividers 40 equally proportioned within two trays 34.

The assembly 10 comprises a plurality of lids 80. Each lid 80 is complementary to and reversibly couplable to a respective tray 34. The lid 80 is couplable to the respective tray 34 such that items positioned within the respective tray 34 are retained in the respective tray 34 when the respective tray 34 is repositioned from a substantially horizontal position to a substantially vertical position.

Each of a plurality of first couplers 50 is coupled to the rim 38 of a respective tray 34 proximate to a corner 52 of the respective tray 34.

A base 53 is coupled to and extends from the vertical support 12 proximate to the bottom end 16. The base 53 is wheeled, such that the base 53 is rollable on a surface. In one embodiment, base 53 comprises a first ring 54 that is positioned around and slidably couplable to the vertical support 12. A plurality of legs 56 is hingedly coupled to and extends from the first ring 54. In another embodiment, plurality of legs 56 comprises three legs 56, such that the base 53 is tripodal. A second ring 58 is positioned around and slidably couplable to the vertical support 12. The second ring 58 is positioned between the first ring 54 and the bottom end 16 of the vertical support 12. Each of a plurality of braces 60 is hingedly coupled to and extends between the second ring 58 and a respective leg 56.

A plurality of wheels 62 is coupled singly to each of the plurality of legs 56 distal from the vertical support 12. The first ring 54 and the second ring 58 are positionable proximate to the bottom end 16 of the vertical support 12, such that the legs 56 are positioned transverse to the vertical support 12. The wheels 62 are positioned on the legs 56 such that the base 53 is rollable. The first ring 54 and the second ring 58 also are positionable distal to the bottom end 16 of the vertical support 12, such that the legs 56 are positioned substantially parallel to the vertical support 12.

A connection box 64 is selectively couplable to a respective tray 34. The connection box 64 is configured to couple electronic devices to a source of alternating current. In one embodiment, connection box 64 comprises a housing 66 that is substantially rectangularly box shaped. A plurality of electrical outlets 68 is coupled to and positioned in the housing 66. In another embodiment, plurality of electrical outlets 68 comprises four electrical outlets 68.

A power cord 70 is operationally coupled to the plurality of electrical outlets 68. The power cord 70 extends from the housing 66 to define a male end 72. The male end 72 is configured to couple to the source of alternating current. In yet another embodiment, the power cord 70 is positioned longitudinally through the vertical support 12.

In still yet another embodiment, a plurality of universal serial bus ports 74 is coupled to and positioned in the housing 66. The universal serial bus ports 74 are operationally coupled to the power cord 70. In still yet another embodiment, the plurality of universal serial bus ports 74 comprises two universal serial bus ports 74.

A second coupler 76 is coupled to and positioned on a lower face 78 of the housing 66. The second coupler 76 is complementary to the first couplers 50. The first couplers 50 are positioned on the trays 34 and are positioned to selectively couple to the second coupler 76 to couple the housing 66 to the respective tray 34. In one embodiment, the top end 14 of the vertical support 12 is complementary to the second coupler 76, such that the housing 66 is selectively couplable to the vertical support 12.

In use, the first ring 54 and the second ring 58 are positionable proximate to the bottom end 16 of the vertical support 12, such that the legs 56 are positioned transverse to the vertical support 12. The wheels 62 are positioned on the legs 56 such that the base 53 is rollable. The arms 32 are hingedly coupled to the vertical support 12 such that the arms 32 are positionable in an extended position with the arms 32 perpendicular to the vertical support 12. The trays 34 are configured to position proximate to a work area. The trays 34 also are configured to retain items, such as tools and electronic devices, within the trays 34 such that the items are readily available to a user. The connection box 64 is configured to couple the electronic devices, such as power tools, to a source of alternating current. The arms 32 also are positionable in a collapsed position with the arms 32 substantially parallel to the vertical support 12. The first ring 54 and the second ring 58 also are positionable distal to the bottom end 16 of the vertical support 12, such that the legs 56 are positioned substantially parallel to the vertical support 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A portable workbench assembly comprising:

a vertical support having a top end and a bottom end;

a horizontal support comprising a pair of arms coupled to and extending substantially perpendicularly from said vertical support in opposite directions proximate to said top end, said arms being hingedly coupled to said vertical support such that said arms are foldable from an extended position wherein said arms are perpendicular to said vertical support to a collapsed position wherein said arms are substantially parallel to said vertical support;

a plurality of trays coupled to said horizontal support, said trays each having at least one compartment configured for positioning and retention of items within said trays; each said tray being slidably attached to a respective said arm, such that a position of each tray is adjustable along a length of said respective arm and pivotable relative to said vertical support;

a base coupled to and extending from said vertical support proximate to said bottom end, said base being wheeled, such that said base is rollable on a surface;

a connection box selectively couplable to a respective said tray, said connection box being configured to couple electronic devices to a source of alternating current; and wherein said base is rollable on the surface such that said trays are configured to be positioned proximate to a work area, wherein said trays are configured to retain items, such as tools and electronic devices, within said trays such that said items are available to a user, and wherein said connection box is configured to couple the electronic devices.

2. The assembly of claim 1, further including said vertical support being tubular, said vertical support comprising a plurality of nested sections, such that said vertical support is variably extendable.

3. The assembly of claim 2, further comprising:

said plurality of nested sections comprising an upper segment and a lower segment;

a plurality of holes positioned in said upper segment, said holes being both linearly and longitudinally positioned in said upper segment;

a locking pin coupled to said lower segment proximate to an upper end of said lower segment, said locking pin being complementary to said holes; and wherein said holes are positioned in said upper segment such that said holes are positioned to couple to said locking pin such that said upper segment is coupled to said lower segment.

4. The assembly of claim 2, further including said vertical support being substantially circularly shaped when viewed longitudinally.

5. The assembly of claim 1, wherein a corresponding tray of said plurality of tray is coupled singly to each said arm.

6. The assembly of claim 1, further including each said tray comprising:

a plate, said plate being substantially rectangularly shaped;

a rim coupled to and extending perpendicularly from a perimeter of said plate; and wherein said trays are substantially rectangularly box shaped.

7. The assembly of claim 1, further including a plurality of dividers reversibly couplable to said trays defining a plurality of compartments, each said divider comprising:

a pair of grooves opposingly positioned in said rim;

a slat reversibly positionable in said grooves; and wherein said slat extends between opposing sides of said rim.

8. The assembly of claim 7, further including said plurality of dividers comprising ten said dividers equally proportioned within two said trays.

9. The assembly of claim 6, further including a plurality of first couplers, each said first coupler being coupled to said rim of a respective said tray proximate to a corner of said respective tray.

10. The assembly of claim 1, further including said base comprising:

a first ring positioned around and slidably couplable to said vertical support;

a plurality of legs hingedly coupled to and extending from said first ring;

a second ring positioned around and slidably couplable to said vertical support, said second ring being positioned between said first ring and said bottom end of said vertical support;

a plurality of braces, each brace being hingedly coupled to and extending between said second ring and a respective said leg;

a plurality of wheels coupled singly to each of said plurality of legs distal from said vertical support; and wherein said first ring and said second ring are positionable proximate to said bottom end of said vertical support such that said legs are extended, wherein said first ring and said second ring are configured to be moved in opposite directions farther apart along said vertical support such that said legs are retracted and pivoted to a position that is substantially parallel with said vertical support.

11. The assembly of claim 10, further including said plurality of legs comprising three said legs, such that said base is tripodal.

12. The assembly of claim 9, further including said connection box comprising:

a housing, said housing being substantially rectangularly box shaped;

a plurality of electrical outlets coupled to and positioned in said housing;

a power cord operationally coupled to said plurality of electrical outlets, said power cord extending from said housing to define a male end, said male end being configured for coupling to the source of alternating current, said power cord being positioned longitudinally through said vertical support;

a second coupler, said second coupler being coupled to and positioned on a lower face of said housing, said second coupler being complementary to said first couplers; and wherein said first couplers are positioned on said trays such that said first couplers are positioned to selectively couple to said second coupler to couple said housing to said respective said tray.

13. The assembly of claim 12, further including said plurality of electrical outlets comprising four said electrical outlets.

14. The assembly of claim 12, further including a plurality of universal serial bus ports coupled to and positioned in said housing, said universal serial bus ports being operationally coupled to said power cord.

15. The assembly of claim 14, further including said plurality of universal serial bus ports comprising two said universal serial bus ports.

16. The assembly of claim 12, further including said top end of said vertical support being complementary to said second coupler, such that said housing is selectively couplable to said vertical support.

17. The assembly of claim 1, further including a plurality of lids, each said lid being complementary to and reversibly couplable to a respective said tray such that items positioned within said respective trays are retained in said respective trays when said respective trays are repositioned from a substantially horizontal position to a substantially vertical position.

18. A portable workbench assembly comprising:

a vertical support having a top end and a bottom end, said vertical support being tubular, said vertical support comprising a plurality of nested sections, such that said vertical support is variably extendable, said plurality of nested sections comprising an upper segment and a lower segment, said vertical support being substantially circularly shaped when viewed longitudinally;

a plurality of holes positioned in said upper segment, said holes being both linearly and longitudinally positioned in said upper segment;

a locking pin coupled to said lower segment proximate to an upper end of said lower segment, said locking pin being complementary to said holes, wherein said holes are positioned in said upper segment such that said holes are positioned to couple to said locking pin such that said upper segment is coupled to said lower segment;

a horizontal support coupled to and extending substantially perpendicularly from said vertical support proximate to said top end, said horizontal support comprising a pair of arms, said arms being hingedly coupled to said vertical support such that said arms are foldable from an extended position wherein said arms are perpendicular to said vertical support to a collapsed position wherein said arms are substantially parallel to said vertical support;

a plurality of trays coupled to said horizontal support, said trays being configured for positioning and retention of items within said trays, each said tray being slidably couplable to a respective said arm, such that each tray is variably positionable relative to said vertical support, wherein a respective tray of said plurality of trays is coupled singly to each said arm, each said tray comprising:

a plate, said plate being substantially rectangularly shaped, a rim coupled to and extending perpendicularly from a perimeter of said plate, and wherein said trays are substantially rectangularly box shaped; a plurality of dividers reversibly couplable to said trays defining a plurality of compartments, each said divider comprising: a pair of grooves opposingly positioned in said rim, a slat reversibly positionable in said grooves, and wherein said slat extends between opposing sides of said rim; said plurality of dividers comprising ten said dividers equally proportioned within two said trays;

a plurality of lids, each said lid being complementary to and reversibly couplable to a respective said tray, such that items positioned within said respective trays are retained in said respective trays when said respective trays are repositioned from a substantially horizontal position to a substantially vertical position;

a plurality of first couplers, each said first coupler being coupled to said rim of a respective said tray proximate to a corner of said respective said tray; a base coupled to and extending from said vertical support proximate to said bottom end, said base being wheeled, such that said base is rollable on a surface, said base comprising:

a first ring positioned around and slidably couplable to said vertical support, a plurality of legs hingedly coupled to and extending from said first ring, said plurality of legs comprising three said legs, such that said base is tripodal, a second ring positioned around and slidably couplable to said vertical support, said second ring being positioned between said first ring and said bottom end of said vertical support, a plurality of braces, each brace hingedly coupled to and extending between said second ring and a respective said leg, a plurality of wheels coupled singly to each of said plurality of legs distal from said vertical support, and wherein said first ring and said second ring are positionable proximate to said bottom end of said vertical support such that said legs are positioned transverse to said vertical support and such that said wheels are positioned on said legs such that said base is rollable, wherein said first ring and said second ring are moved in opposite directions along said vertical support and spaced farther apart such that said legs are positioned substantially parallel to said vertical support; a connection box selectively couplable to a respective said tray, said connection box being configured to couple electronic devices to a source of alternating current, said connection box comprising: a housing, said housing being substantially rectangularly box shaped, a plurality of electrical outlets coupled to and positioned in said housing, said plurality of electrical outlets comprising four said electrical outlets, a power cord operationally coupled to said plurality of electrical outlets, said power cord extending from said housing to define a male end, said male end being configured for coupling to the source of alternating current, said power cord being positioned longitudinally through said vertical support, a plurality of universal serial bus ports coupled to and positioned in said housing, said universal serial bus ports being operationally coupled to said power cord, said plurality of universal serial bus ports comprising two said universal serial bus ports, a second coupler, said second coupler being coupled to and positioned on a lower face of said housing, said second coupler being complementary to said first couplers, and wherein said first couplers are positioned on said trays such that said first couplers are positioned to selectively couple to said second coupler to couple said housing to said respective said tray; said top end of said vertical support being complementary to said second coupler, such that said housing is selectively couplable to said vertical support; and wherein said trays are configured to be positioned proximate to a work area, wherein said trays are configured to retain items, such as tools and electronic devices, within said trays such that said items are available to a user, and wherein said connection box is configured to couple the electronic devices, and wherein said arms are positionable in a collapsed position wherein said arms are substantially parallel to said vertical support.

* * * * *